US008985229B2

(12) United States Patent
Edvardsen et al.

(10) Patent No.: US 8,985,229 B2
(45) Date of Patent: Mar. 24, 2015

(54) SEALING ARRANGEMENT, AND CORRESPONDING METHOD

(75) Inventors: Per Espen Edvardsen, Fyllingsdalen (NO); Tom Kjetil Askeland, Straume (NO)

(73) Assignee: Siem Wis AS, Knarrevik (NO)

( * ) Notice: Subject to any disclaimer, the term of this patent is extended or adjusted under 35 U.S.C. 154(b) by 770 days.

(21) Appl. No.: 12/670,779

(22) PCT Filed: Jul. 24, 2008

(86) PCT No.: PCT/NO2008/000274

§ 371 (c)(1),
(2), (4) Date: Jun. 7, 2010

(87) PCT Pub. No.: WO2009/017418

PCT Pub. Date: Feb. 5, 2009

(65) Prior Publication Data

US 2011/0308818 A1 Dec. 22, 2011

(30) Foreign Application Priority Data

Jul. 27, 2007 (NO) ..... 20073935

(51) Int. Cl.
*E21B 33/03* (2006.01)
*E21B 33/02* (2006.01)
*E21B 33/08* (2006.01)

(52) U.S. Cl.
CPC ..... *E21B 33/08* (2013.01)
USPC ..... 166/387; 166/358; 166/360; 166/127; 166/191

(58) Field of Classification Search
CPC ..... E21B 33/08
USPC ..... 166/387, 84.4, 84.2, 127, 191, 345, 166/382; 175/7, 8
See application file for complete search history.

(56) References Cited

U.S. PATENT DOCUMENTS 1,875,632 A 9/1932 McEvoy
2,064,577 A 12/1936 Starr
(Continued)

FOREIGN PATENT DOCUMENTS

DE 2643769 A1 3/1978
DE 3339316 A1 5/1985
(Continued)

OTHER PUBLICATIONS

Patent Cooperation Treaty, International Search Report and Written Opinion, International Application No. PCT/NO2008/00125, mailed Aug. 22, 2008.
(Continued)

*Primary Examiner* — James G Sayre
(74) *Attorney, Agent, or Firm* — Kilpatrick Townsend & Stockton LLP

(57) ABSTRACT

A sealing arrangement and method for dynamic sealing around a drill stem (50) in water-carrying, drilling fluid-carrying or hydrocarbon-carrying wells, comprising at least one dynamic sealing (35*a*) which is arranged to envelop the drill stem (50), and a receiver unit (30) arranged to receive the at least one sealing (35*a*), with the dynamic sealing being arranged to be driven into the receiver unit (30) with the help of the drill stem, and to be securely locked in the receiver unit, and also that internal pressure support in the sealing arrangement is provided corresponding to at least the surrounding pressure. The receiver unit (30) is arranged in an area in or near the drill deck of a drilling rig or vessel and in a riser, landing string or in another connection between drill deck and a well to close the return side of the drilling fluid between the drill stem and upper part of the riser, with the receiver unit (30), in connection with a floating rig or drilling ship, being arranged below the compensating unit (21) of the riser to make movement compensation possible between riser (20) and surface vessel (10), or that the receiver unit (30) in connection with a fixed installation, is arranged as a part of the riser connection (20).

6 Claims, 11 Drawing Sheets

(56) References Cited

U.S. PATENT DOCUMENTS

| | | | | | |
|---|---|---|---|---|---|
| 2,222,082 | A * | 11/1940 | Leman et al. | 175/195 |
| 2,682,068 | A | 6/1954 | Harrigan | |
| 3,215,203 | A | 11/1965 | Sizer | |
| 3,387,851 | A * | 6/1968 | Cugini | 277/318 |
| 3,474,858 | A | 10/1969 | Gibson et al. | |
| 3,965,987 | A * | 6/1976 | Biffle | 166/379 |
| 4,149,603 | A | 4/1979 | Arnold | |
| 4,162,704 | A | 7/1979 | Gunther | |
| 4,315,553 | A | 2/1982 | Stallings | |
| 5,474,097 | A | 12/1995 | Lowe et al. | |
| 6,119,772 | A | 9/2000 | Pruet | |
| 6,325,159 | B1 | 12/2001 | Peterman et al. | |
| 6,412,554 | B1 | 7/2002 | Allen et al. | |
| 6,581,692 | B1 | 6/2003 | Koch et al. | |
| 6,688,394 | B1 | 2/2004 | Ayling | |
| 6,739,397 | B2 | 5/2004 | Ayling | |
| 7,188,683 | B2 | 3/2007 | Ayling | |
| 7,258,171 | B2 | 8/2007 | Bourgoyne et al. | |
| 7,438,135 | B2 * | 10/2008 | Page et al. | 166/387 |
| 7,779,903 | B2 | 8/2010 | Bailey et al. | |
| 2003/0221519 | A1 | 12/2003 | Haugen | |
| 2005/0061499 | A1 | 3/2005 | Hopper | |
| 2006/0037782 | A1 | 2/2006 | Martin-Marshall | |
| 2006/0065402 | A9 * | 3/2006 | Fontana et al. | 166/358 |
| 2009/0166046 | A1 | 7/2009 | Edvardson et al. | |
| 2010/0147525 | A1 | 6/2010 | Lerner et al. | |
| 2010/0175882 | A1 | 7/2010 | Bailey et al. | |
| 2010/0218937 | A1 | 9/2010 | Edvardsen et al. | |
| 2012/0292054 | A1 * | 11/2012 | Orbell et al. | 166/387 |

FOREIGN PATENT DOCUMENTS

| | | | |
|---|---|---|---|
| EP | 1 462 687 | A1 | 9/2004 |
| EP | 1 519 003 | A1 | 3/2005 |
| NO | 317 227 | | 9/2004 |
| WO | WO 99/49173 | A1 | 9/1999 |
| WO | WO 2006/010906 | A1 | 2/2006 |
| WO | WO 2007/008085 | A1 | 1/2007 |

OTHER PUBLICATIONS

Patent Cooperation Treaty, International Preliminary Report on Patentability, International Application No. PCT/NO2008/00125, date completed Aug. 19, 2009.

Patent Cooperation Treaty , Written Opinion of the International Preliminary Examining Authority, International Application No. PCT/US2008/000125, mailed Jun. 10, 2009.

Patent Cooperation Treaty, International Search Report, International Application No. PCT/NO2006/00272, mailed Oct. 31, 2006.

Patent Cooperation Treaty, Written Opinion, International Application No. PCT/NO2006/00272, mailed Oct. 31, 2006.

Patent Cooperation Treaty, International Search Report, International Application No. PCT/NO2008/000274, mailed Nov. 4, 2008.

Patent Cooperation Treaty, Written Opinion, International Application No. PCT/NO2008/000274, mailed Nov. 4, 2008.

Patent Cooperation Treaty, International Preliminary Report on Patentability, International Application No. PCT/US2008/000274, dated Aug. 21, 2009.

Patent Cooperation Treaty, International Search Report, International Application No. PCT/NO2008/000228, mailed Aug. 10, 2008.

Patent Cooperation Treaty, Written Opinion, International Application No. PCT/NO2008/000228, mailed Aug. 10, 2008.

Patent Cooperation Treaty, International Preliminary Report on Patentability, International Application No. PCT/NO2008/000228, dated Aug. 9, 2009.

United States Patent and Trademark Office, Office Action, U.S. Appl. No. 11/988,524, mailed Dec. 21, 2010.

United States Patent and Trademark Office, Notice of Allowance and Fees Due, U.S. Appl. No. 11/988,524, mailed Sep. 12, 2011.

United States Patent and Trademark Office, Response to Office Action, U.S. Appl. No. 11/988,524, filed Jun. 20, 2011.

United States Patent and Trademark Office, Office Action, U.S. Appl. No. 12/597,823, mailed Dec. 21, 2010.

United States Patent and Trademark Office, Response to Office Action, U.S. Appl. No. 12/597,823, filed Jun. 20, 2011.

United States Patent and Trademark Office, Notice of Allowance, U.S. Appl. No. 12/597,823, mailed Jul. 15, 2011.

Patent Cooperation Treaty, International Search Report, International Application No. PCT/NO2011/000166, dated Sep. 20, 2011.

* cited by examiner

SEALING ARRANGEMENT, AND CORRESPONDING METHOD

The present invention relates to a sealing arrangement, and a corresponding method, for dynamic sealing around a drill stem in water-carrying, drilling fluid-carrying or hydrocarbon-carrying wells, comprising at least one dynamic seal which is arranged to envelop the drill stem and a receiver unit arranged to receive at least the one seal with the dynamic seal being arranged to be driven into the receiver unit with the help of the drill stem, and to be securely locked in the receiver unit, and also that an internal pressure support is provided in the sealing arrangement, at least corresponding to the surrounding pressure.

The invention can be used to seal around the drill stem or coil pipe that moves into, or out of, oil wells and gas wells in all water-carrying wells, drilling fluid-carrying wells or hydrocarbon-carrying wells, wells that have a wellhead Christmas tree (well safety valves) placed on the ocean bottom, a platform, vessel, installation or on land. With the expression riser is meant any connection between drilling rig or drilling platform, such as a riser, landing string or other connection.

The invention relates to sealing arrangements and methods that make it possible to intervene and drill in the above mentioned water-carrying wells, drilling fluid-carrying wells or hydrocarbon-carrying wells by using a landing string, riser connection or other connection between the well and drill deck on surface vessels, platforms or other installations. The invention can also be used above, in between or below well control equipment elements, irrespective of whether the wellhead Christmas tree of the well is placed on the ocean bottom or on the surface. The sealing arrangement and method covers work in the above mentioned water-carrying wells, drilling fluid-carrying wells or hydrocarbon-carrying wells, carried out with the help of a drill stem, a snubbing string and a coil pipe, and also said method based on use of new composite and thermoplastic materials and also complimentary solutions.

Drill stem, snubbing string and coiled pipes are hereafter mentioned under the description drill stem. With the expression downhole tools, one must understand different tools for operation in a well, i.e. equipment for drilling operations, intervention equipment, equipment for logging, measurements, fishing, etc.

Water-carrying, drilling fluid-carrying or hydrocarbon-carrying wells are hereafter referred to with the description well.

The invention will, in a simplified way, represent a dynamic sealing around a drill stem that moves into, or out of, a well. The invention relates to both situations where the well pressure is higher than or equal to the surrounding pressure at the wellhead Christmas tree.

The invention will be especially suited to operations that involve drilling with conventional drilling equipment and systems as the invention appears as an addition to these, at the same time as it represents increased operational possibilities.

Today's methods to carry out well interventions or drilling in wells with the help of a drill stem or a coil pipe are based on using a riser connection between the well head and the equipment on the drill deck. Normally, one drills using a drilling fluid which has a greater specific density than what is expected of pressure from the formation, and normally the top of the riser will then be open with free access to the drilling fluid between the drill stem and the riser (annular space).

More and more reservoirs have challenges as a consequence of loss of pressure, or too high pressure and high temperature. For wells with loss in pressure the opportunity to be able to drill them will increase if the weight of the drilling fluid and thus the pressure on the formation can be reduced. For it to be possible to carry this out, there must be a seal between drill stem and the riser to be able to handle any pressure from the formation as a consequence of the safety margin being reduced because of the lighter drilling fluid. For reservoirs with high pressure and high temperature, it is desirable to be able to maintain the pressure in the formation during drilling. This can be achieved by sealing between the drill stem and riser for thereafter to pressurise the riser until the pressure at the end of the drill stem is equal to the surrounding pressure from the formation. Then, one can drill with a reduced risk for formation damage.

Today, there are systems for dynamic sealing between drill stem and riser, where this equipment is mounted onto the top of the riser. One of the challenges with the existing dynamic sealing systems is their physical size, and also the complexity with many moving parts.

Furthermore, reference is made to U.S. Pat. No. 6,325,159 where a stripper arrangement and an arrangement of seals which surround the drill stem, among others, are described. The arrangement comprises a series of elastomeric gaskets. The scrubber arrangement can be received in a receiver unit and can be driven in with the help of tools mounted on the drill stem. However, this scrubber arrangement can not provide internal pressure support in the element. Each of the seals is only arranged to take up a small part of the total pressure difference across the stripping element, thus to give a low pressure sealing around the drill stem. It is described that the receiver unit is placed on a subsea BOP and that the riser coupling is connected to the lower part of the riser and to the receiver unit to lead mud back to a pump for further transport. Also described in said U.S. Pat. No. 6,325,159 is that the riser is filled with seawater or another liquid.

This is directly contrary to the present invention. The sealing arrangement according to the invention is preferably placed between the drill deck and a well, in an area in or close to the drill deck of a drilling rig or vessel, and where internal pressure support, for one thing, is provided in the sealing arrangement, at least corresponding to the surrounding pressure. The aim of the present solution is to both make possible and maintain the pressure in, for example, the riser, and to only pressure release the compensating unit (sliding joint) at the top. This then leads to, for example, that a floating rig can continue to operate and compensate as normal. With the solution described in U.S. Pat. No. 6,325,159, this will not be possible.

Furthermore, U.S. Pat. No. 6,325,159 describe a two gradient drilling method to reduce the pressure load on the formation, and also to be able to drill without a riser. This is also contrary to the present invention, which can be used in a drilling method where one wants higher pressure on the formation than what can simply be achieved with the weight of the drilling fluid. It is thereby possible to use conventional drilling equipment, such as compensating units (sliding joint), risers, etc.

No. 324167 shows a system for dynamic sealing around a drill stem, and which is in use without a riser or landing string being mounted. The sealing arrangement according to No. 324167 is mounted to existing equipment down on the well, and not as given in the present application, in an area in or close to the drill deck of a drilling rig or vessel.

Both known solutions, U.S. Pat. No. 6,325,159 and No. 324167 are for subsea use. There are no descriptions or references in any of the documents that lead to a person skilled in the arts being able to mount such a stripper arrangement—or alternative sealing arrangement adjoining the drill deck.

The present invention can in connection with a drilling rig or drilling vessel be arranged below the compensating unit of the riser, or in connection with a fixed installation, be arranged as a part of the riser connection.

The present invention has as an aim to make possible the carrying out of a safer and less expensive well intervention and drilling operation by closing the return side of the drilling fluid between the drill stem and the riser (annular space). In addition, the invention will contribute to wells, which with today's technology can not be drilled, being able to be drilled.

The sealing arrangement with associated equipment has a predominantly main configuration, and this will be adapted to the outer diameter of the string which shall pass through the sealing.

The present sealing arrangement for a dynamic sealing around a drill stem in water-carrying, drilling fluid-carrying or hydrocarbon-carrying wells, comprises a sealing arrangement mounted together with other equipment and adjoining systems which are necessary to carry out the operation in the well, whether it is an ocean bottom based well or a surface well, where the sealing arrangement is a collectable seal for well intervention with the help of a drill stem. The seal can be configured to withstand pressure from both sides and thus both prevent well medium flowing out to the surroundings or that the surrounding medium flows into the well. Furthermore, a lubricant/liquid with high viscosity can be injected with high pressure into the seal, and also between the sealing sets to provide pressure support to the sealing sets, and/or to prevent through flow of liquid or gasses in the sealing, and also to reduce the friction and provide cooling between seal and drill stem.

With the present sealing arrangement, the drill stem can move into or out of the well at maximum well pressure. The sealing arrangement is preferably controlled, monitored and connected to a suitable control system.

A preferred embodiment of the sealing arrangement according to the invention is described herein, in that the receiver unit is arranged in an area in or near to the drill deck of a drilling rig or vessel and in a riser, landing string or in another connection between drilling deck and a well, to shut the return side of the drilling fluid between drill stem and the upper part of the riser, with the receiver unit connection with a floating rig or drilling ship being arranged below the compensating unit of the riser to make compensation for movement possible between riser and a surface vessel, or that the receiver unit in connection with a fixed installation is arranged as a part of the riser connection.

Alternative preferred embodiments of the sealing arrangement are also described herein, in that the receiver unit is arranged to receive a number of successive sealing sets, where each sealing is arranged to be securely locked with the help of respective locking appliances, arranged mutually spaced apart longitudinally in the receiver unit.

Each of said sealing sets can comprise at least one disc-formed or ring-formed gasket element from an elastic material, such as an elastomeric material, arranged to envelop the drill stem. Furthermore, an annular space can be provided, between and through each individual set of sealing elements, arranged to receive an injected pressure medium, such as a lubricant/liquid with high viscosity through dedicated lines, where the pressure medium is arranged to increase the characteristics of the sealing to withstand pressure, lubricate the contact surface between sealing and drill stem to achieve a lower friction, and also to cool the friction surface.

In the running of spare seals, this can be carried out without having to remove the previous seal(s), in that the new seal is placed over the previous seal(s) and comes in as an addition to the previous seal(s). Running a spare seal can be carried out, independent of where one is in the drilling operation as it shall be mounted before the previous seal has lost its sealing functioning.

After the operation has ended, the sealing(s) which is (are) mounted is (are) pulled out in one operation to release the locking device for the sealings, thereafter to pull the drill stem out of the well. The sealings will then come out hanging on the drill stem.

A preferred embodiment of the method according to the invention is described herein, in that to close the return side of the drilling fluid between drill stem and the upper part of the riser, the following steps are carried out:

- mounting the receiver unit in a riser, landing string or the like, in an area in or near the drill deck of a drilling rig or vessel, in which the receiver unit in connection with a floating rig or drilling vessel is arranged below the compensating unit of the riser to make movement compensation possible between riser and the surface vessel, or in connection with a fixed installation, to arrange the receiver unit as a part of the riser connection,
- running the drill stem into the riser, landing string or the like, with a sealing unit attached, and
- entering and locking the sealing unit to the receiver unit which is mounted as a part of the connection to the well.

Alternative preferred embodiments of the method are also described herein, in that the running of subsequent seals can be carried out without having to remove the first installed sealing, with the receiver unit being arranged to receive a number of sets of seals in succession, where each seal is securely locked with the help of respective locking devices arranged mutually spaced apart longitudinally in the receiver unit.

A lubricant/liquid with high viscosity or another medium can be injected at high pressure into the sealing, through defined lines to provide pressure support to the sealings so that they withstand pressure, and thus prevent well medium from flowing out to the surroundings. The lubricant/liquid with high viscosity injected into and between the sets of seals lower the friction between the sets of seals and drill stem, and also cool the sealing surfaces.

Placing the sealing arrangement below the compensating unit of the riser in connection with a floating rig or drilling ship makes movement compensation between riser and surface vessel possible for the use of standard equipment.

In the cases described above, pressure and liquid can be led out through a return line below the sealing arrangement and up to associated systems, for further processing, and control of the sealing arrangement can be carried out via a control line and an associated surface system.

For pulling sealing elements out from the receiver unit after final use of the last mounted sealing or all the sealings, it or they can be pulled out by opening the dedicated locking devices thereafter to pull the sealings out by pulling the drill stem out of the well.

Furthermore, the lubricant/liquid with high viscosity injected between the sets of seals prevents liquid or gases flowing through the sealing arrangement and lowers the friction between the sets of seals and drill stem.

In connection with drilling operations in wells with the help of a drill stem, the necessary complimentary systems will be used to maintain other functions which are required for carrying out the operation (cutting and sealing functions, disconnecting systems, drilling fluid systems, etc). The power supply to the drill stem (snubbing) will be taken care of other systems according to need. This invention incorporates only the dynamic sealing function and method, with its unique associated systems.

The invention does not take into account how the tool and the string which shall be inserted into the well are operated or driven, and covers as such any form for such methods.

The invention shall now be described in more detail with reference to the enclosed drawings, in which.

The FIGS. 4-10 show the running of seals into the sealing arrangement according to the invention.

Figure 11:
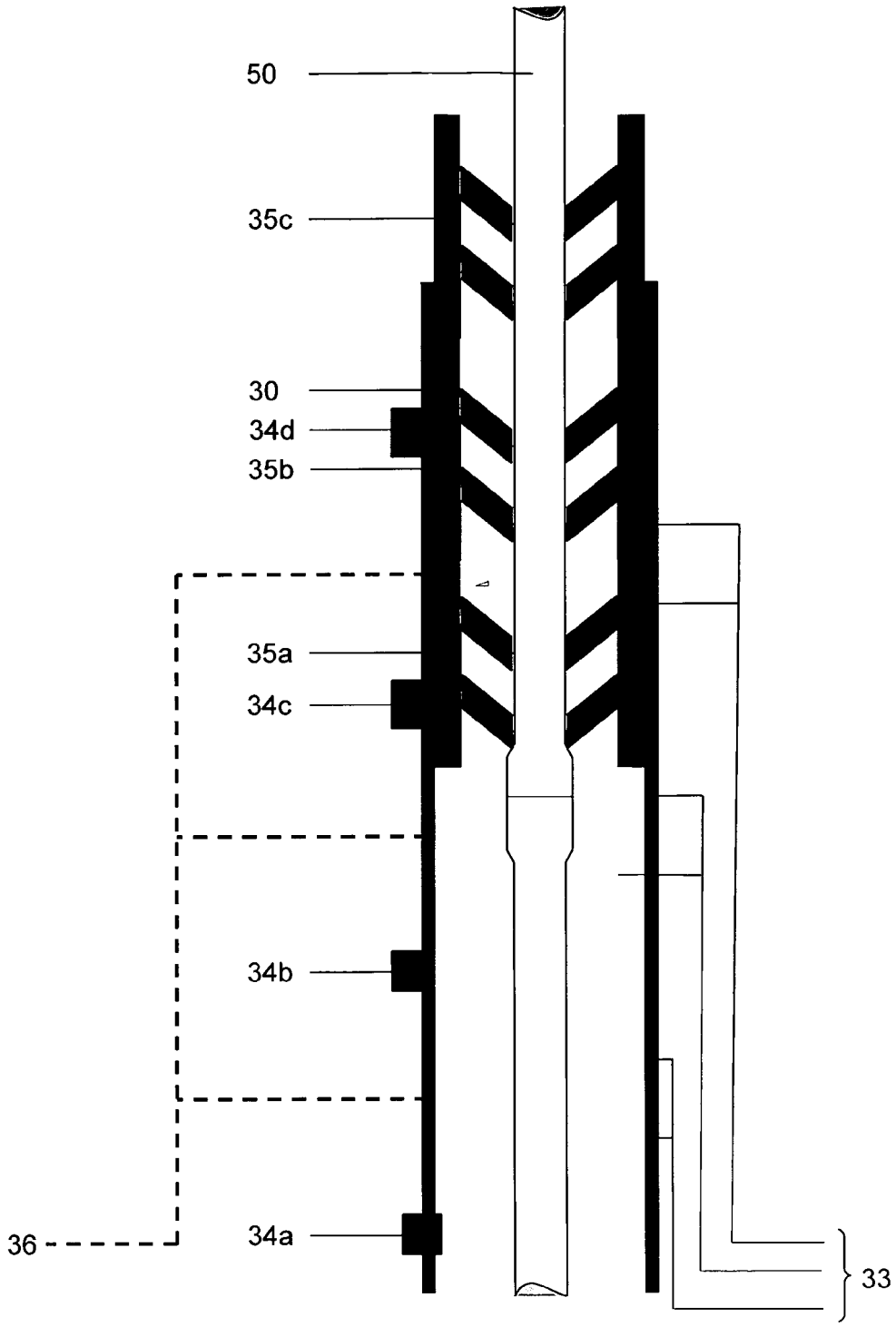

FIG. 11 shows the pulling out of seals from the sealing arrangement according to the invention.

Figure 1:
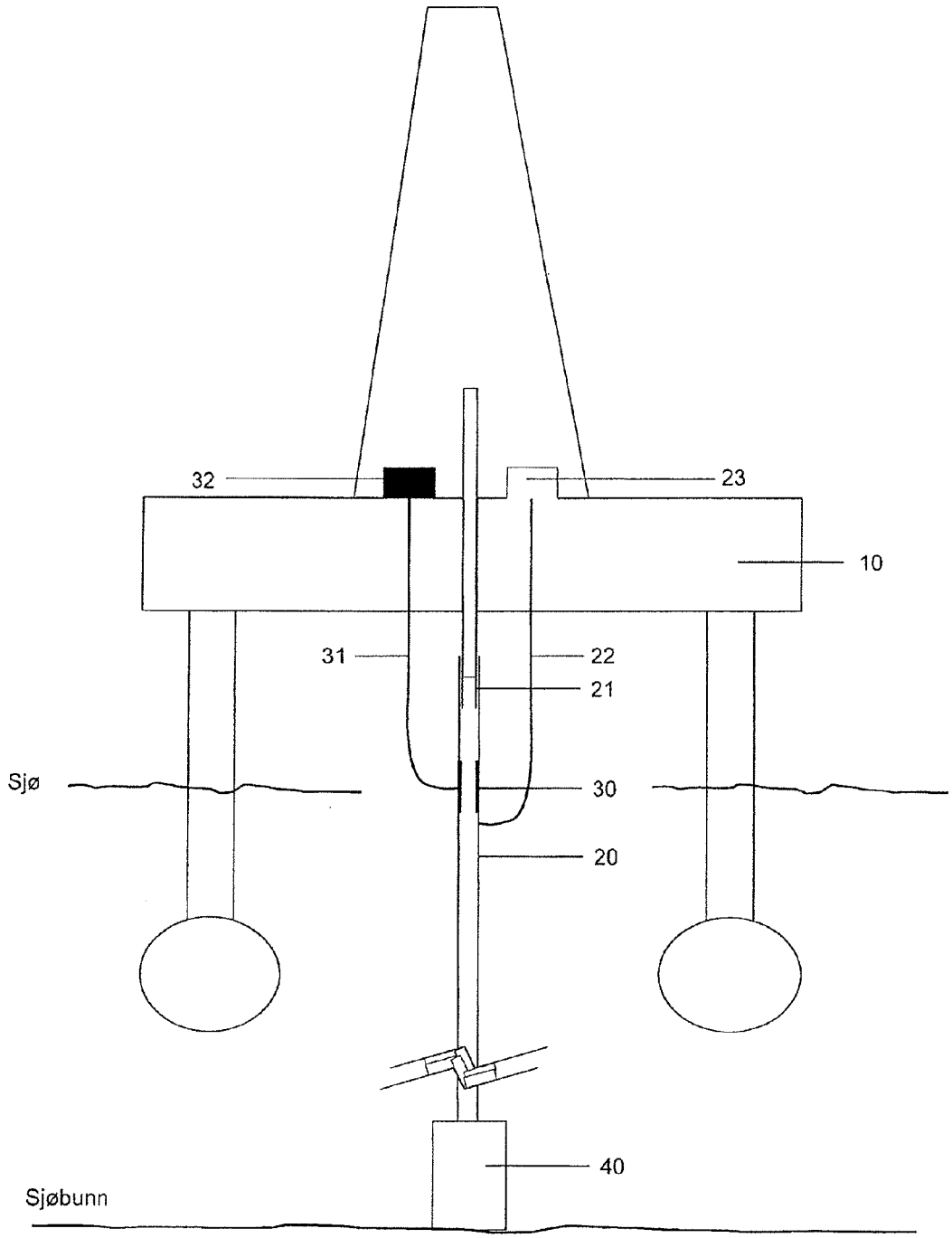
FIG. 1 shows use of the sealing arrangement according to the invention on a fixed installation.

FIG. 1 shows an application of the present sealing arrangement 30 localised as a part of the connection between well 40 and surface vessel 10 (floating rig or drilling ship) in connection with a drilling operation. In that the present sealing arrangement 30 is preferably placed below the compensating unit (slip joint) 21 of the riser, movement compensation is made possible between riser 20 and the surface vessel 10 with use of standard equipment, even when the rest of the riser is pressurized. Pressure and liquid are fed out through a return line 22 below the present sealing arrangement 30 and up to associated systems 23 for further processing. Control of the present sealing arrangement takes place via a control line 31 and an associated surface system 32.

Figure 2:
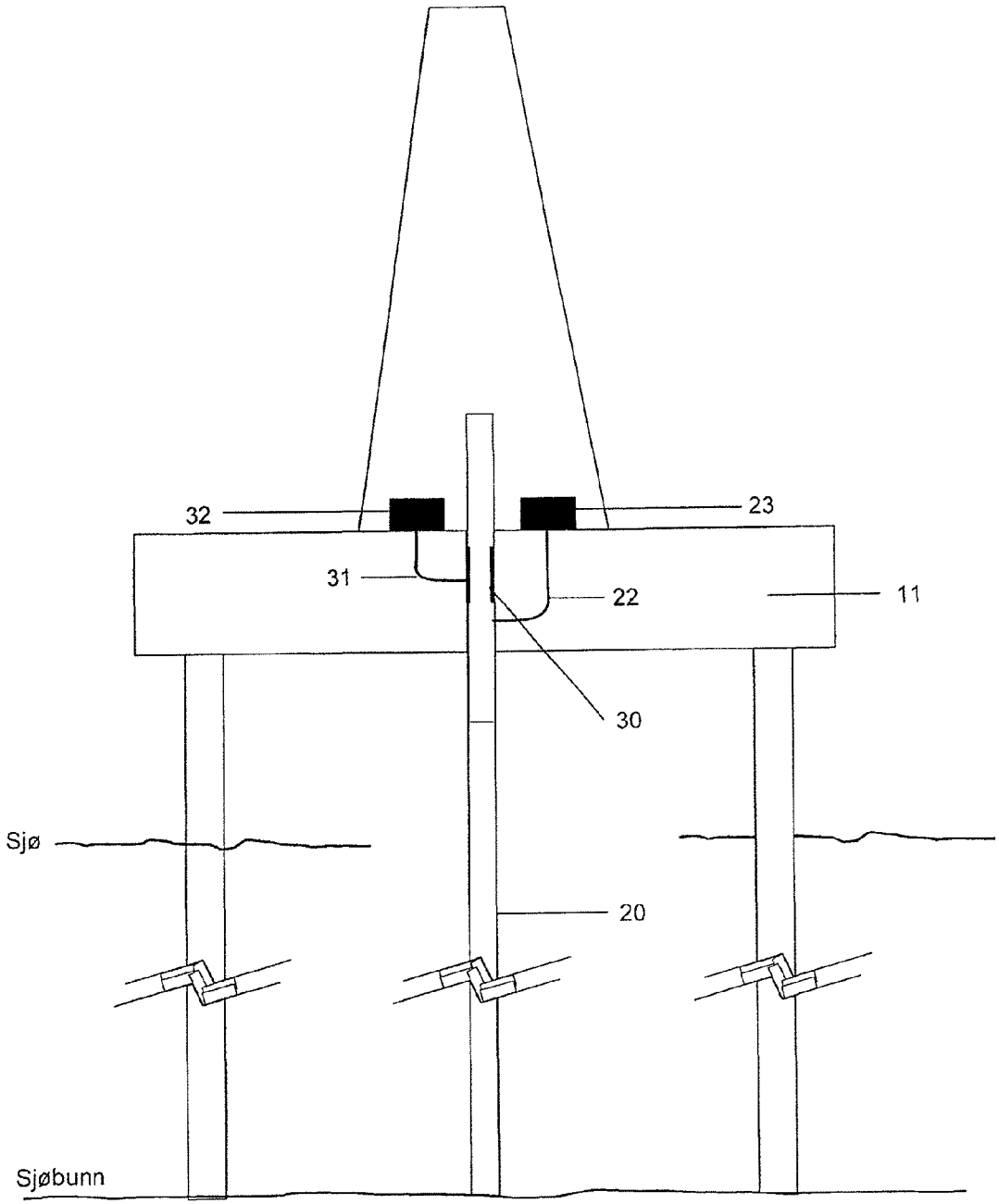
FIG. 2 shows use of the sealing arrangement according to the invention on a floating installation.

FIG. 2 shows an application of the present sealing arrangement 30 located as a part of the riser connection 20 on a fixed installation 11 (platform, jack-up rigs or tension leg platform) in connection with a drilling operation (well safety equipment is not shown). Pressure and liquid are led out through a return line 22 below the present sealing arrangement 30 and up to associated systems 23 for further processing. Control of the present sealing arrangement takes place via a control line 31 and an associated surface system 32.

Figure 3:
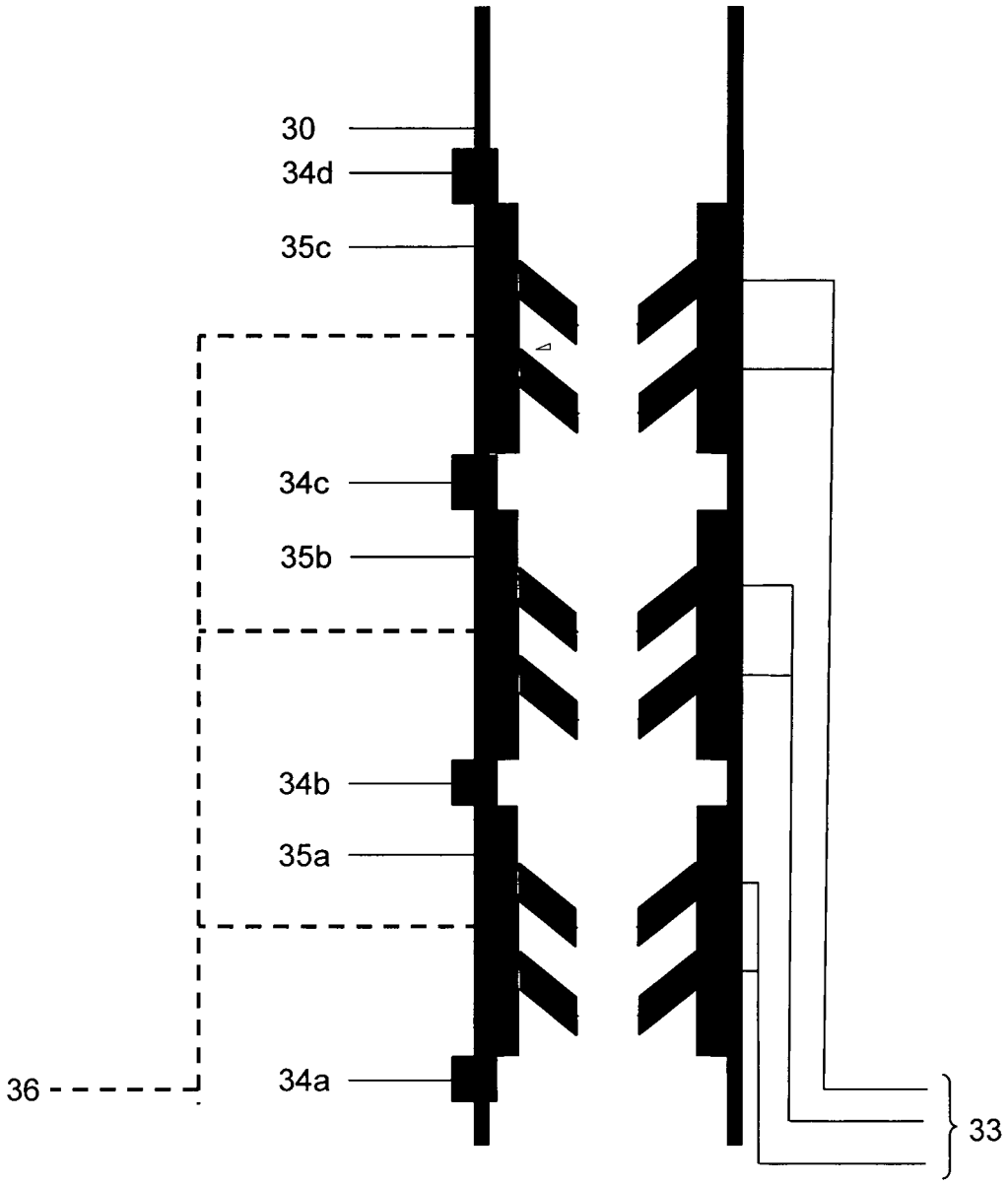
FIG. 3 shows a sealing arrangement according to the invention in more detail.

FIG. 3 shows an embodiment of the present sealing arrangement in more detail. The receiver part 30 which can be part of the riser is the outermost container for pressure and medium. Seals 35*a*, 35*b*, and 35*c* are arranged in the receiver part 30. Three seals are shown here, but the invention can be configured with both fewer and more seals, dependent on embodiment and application. Locking devices 34*a*, 34*b*, 34*c* and 34*d* are arranged to keep the seals 35*a*, 35*b* and 35*c* in place in the receiver part 30, where the locking devices can comprise conventional appliances for retention and release of the seals. The system can be equipped with lines 33 for injection of a friction-reducing medium and/or pressure-supporting medium. Control and monitoring of the seals 35*a*, 35*b* and 35*c*, the locking devices 34*a*, 34*b*, 34*c* and 34*d*, pressure and temperature take place via the control and monitoring line 36.

In the following, different example embodiments shall be described but it must be understood that other configurations are also possible within the frame of the invention.

The configuration and the sealing arrangement can be used irrespective of the wellhead Christmas tree being located on the ocean bottom or being available on the surface/land. The sealing arrangement refers to FIGS. 1 and 2 that show an embodiment of the present sealing arrangement located as a part of the riser connection 20 in an imaginary configuration in connection with a drilling operation. The sealing arrangement can be placed above, between and below the other well safety equipment which is part of the drilling operation, independently of the location of the valve tree (ocean bottom or surface).

Method for installation of sealing and spare seals 35*a* and 35*b*, 35*c* and also pulling out of seals after final use. The receiver part 30 of the seals will be arranged at the same time as other equipment which is required to be able to carry out the drilling operation. The seals 35*a*, 35*b* and 35*c* will be installed when required by the operation.

Figure 4:
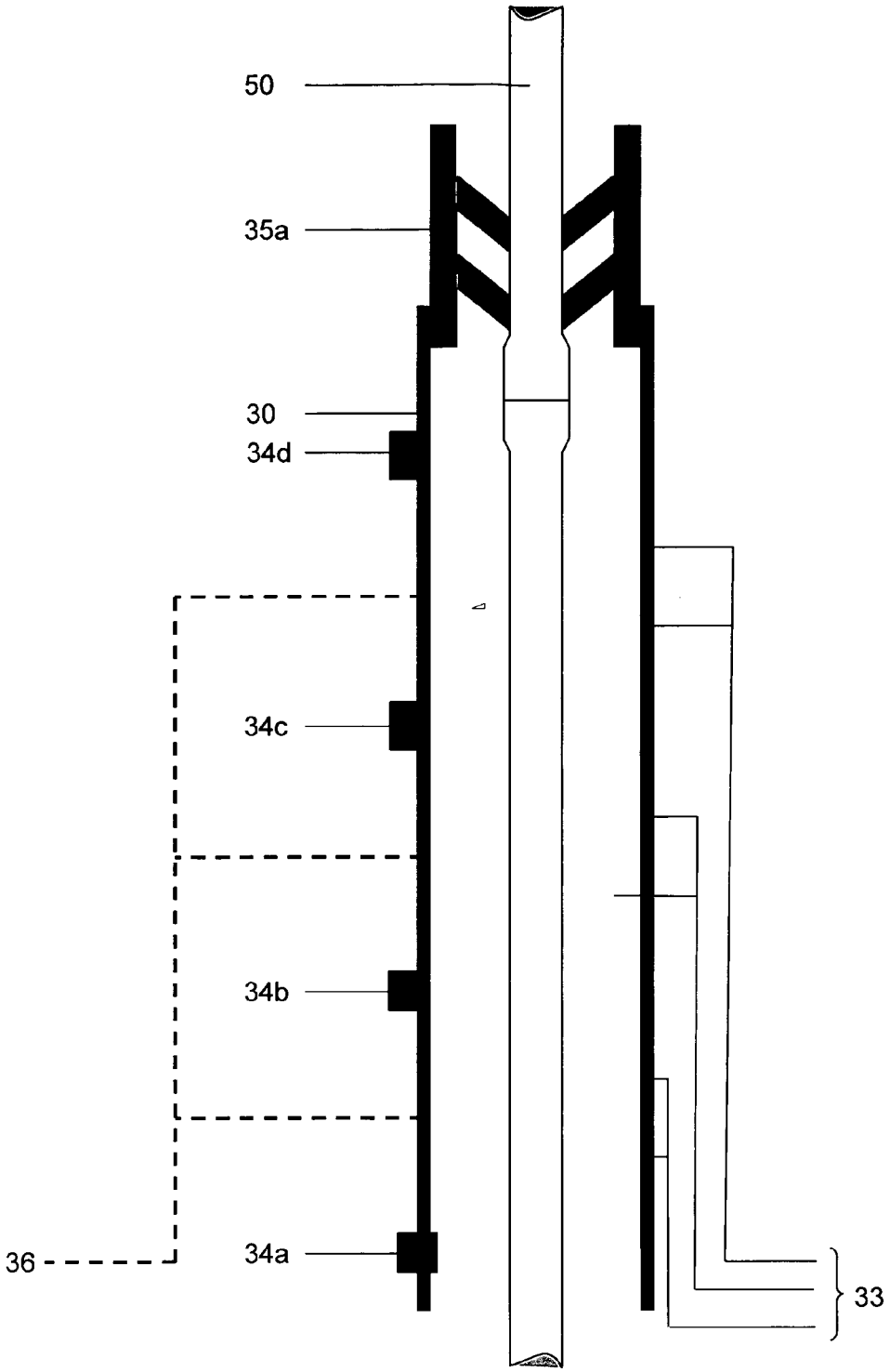

FIG. 4 shows installation of the first and lowest seal, 35*a* in the present sealing arrangement, located suspended on an imaginary drill stem in connection with a drilling operation. The sealing arrangement which is referred to in FIG. 4 shows a dynamic sealing unit 35*a* driven onto a drill stem/intervention string 50 and a receiver unit 30 located in the pipe connection coupled to the well. It can be seen that the dynamic sealing unit 35*a* is led into the receiver part 30 with the help of the drill stem 50.

Figure 5:
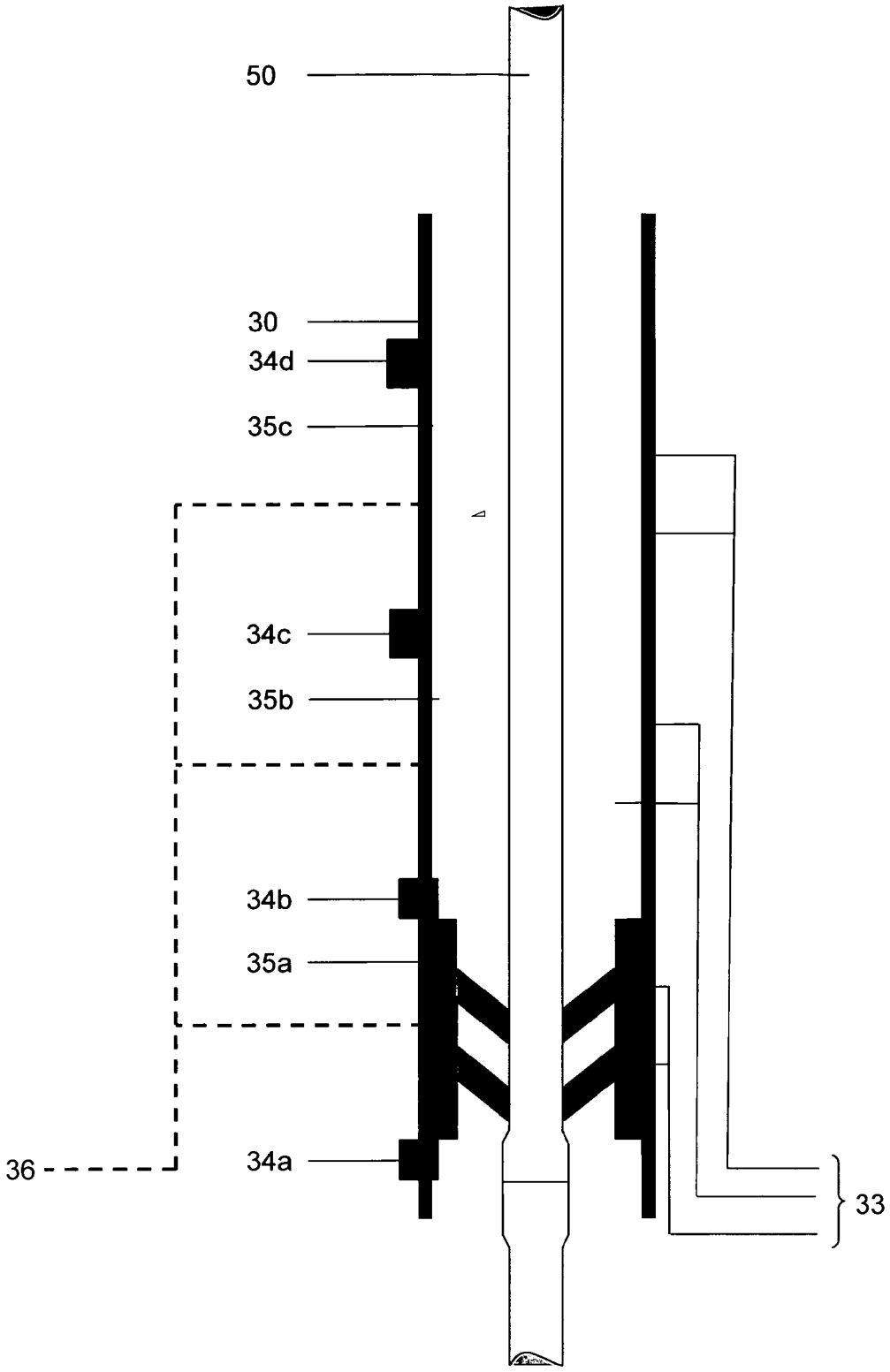

FIG. 5 shows that the first seal 35*a* is locked in place with the help of the locking devices 34*a* and 34*b*. The seal 35*a* is thereafter tested and verified with the help of pressure testing and other suitable methods. Injection of friction reducing, sealing and pressure supporting medium can now take place via dedicated injection lines 33. After the necessary tests and verifications have been carried out, the sealing is ready to be used and the drilling operation can continue with or without pressure in the pipe during the sealing. The seal 35*a* must be able to withstand a predefined pressure, both for a static as well as for a dynamic drill stem 50. Control and monitoring of the sealing is continuously carried out via dedicated sensors and systems via a control line 36.

Figure 6:
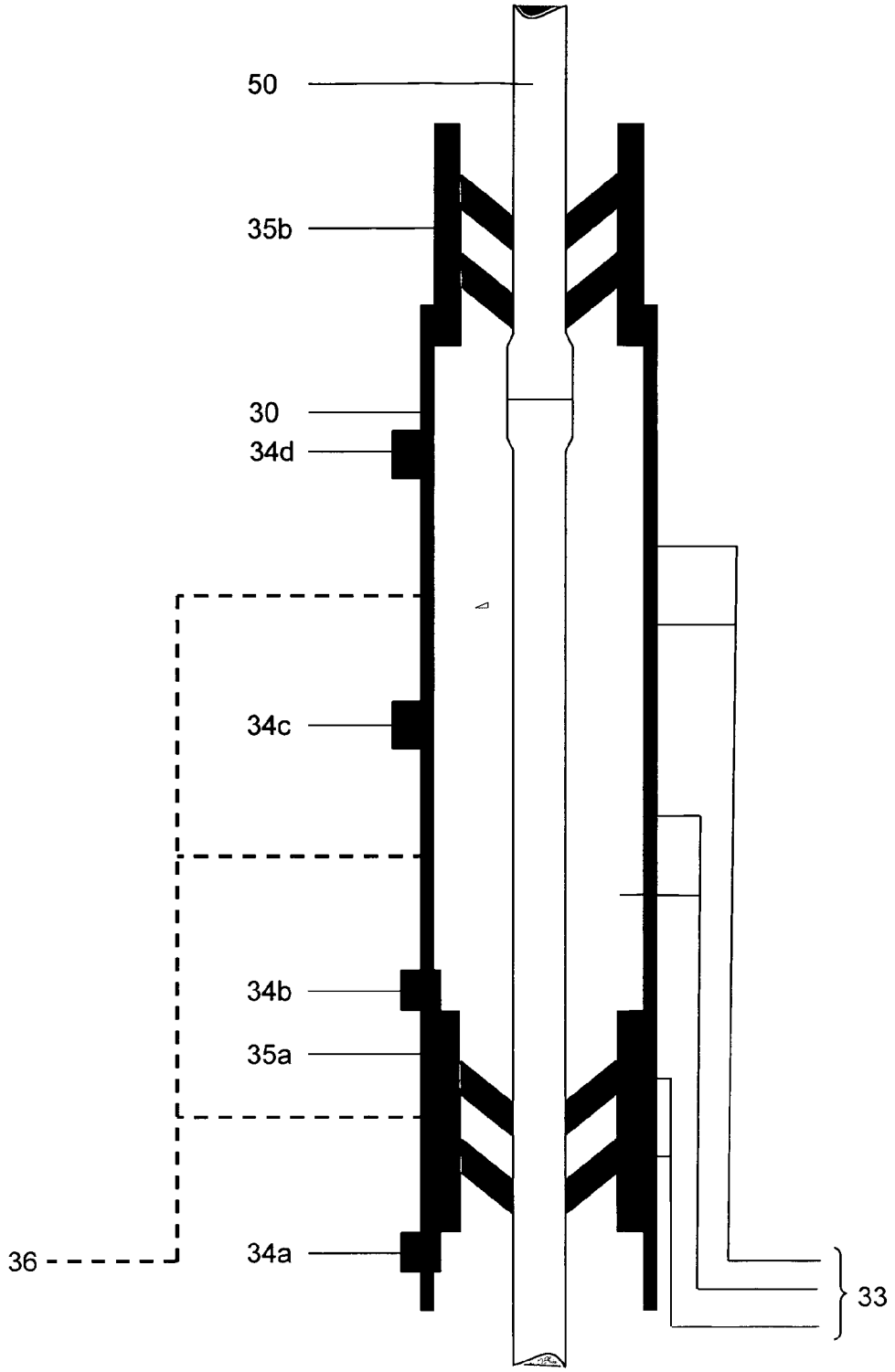

FIG. 6 shows operation of the next seal 35*b*, a so-called spare sealing. The individual sealing is constructed and is intended to have a duration determined in advance with respect to wear and tear. When this limit is being approached, or one has other indications of wear and tear or a weakening in the initially installed sealing, one can choose to install the spare seal 35*b* to be able to continue the drilling operation, or to ensure safe operative conditions. The spare seal 35*b* is driven down in the receiver part 30 suspended on the drill stem 50.

Figure 7:
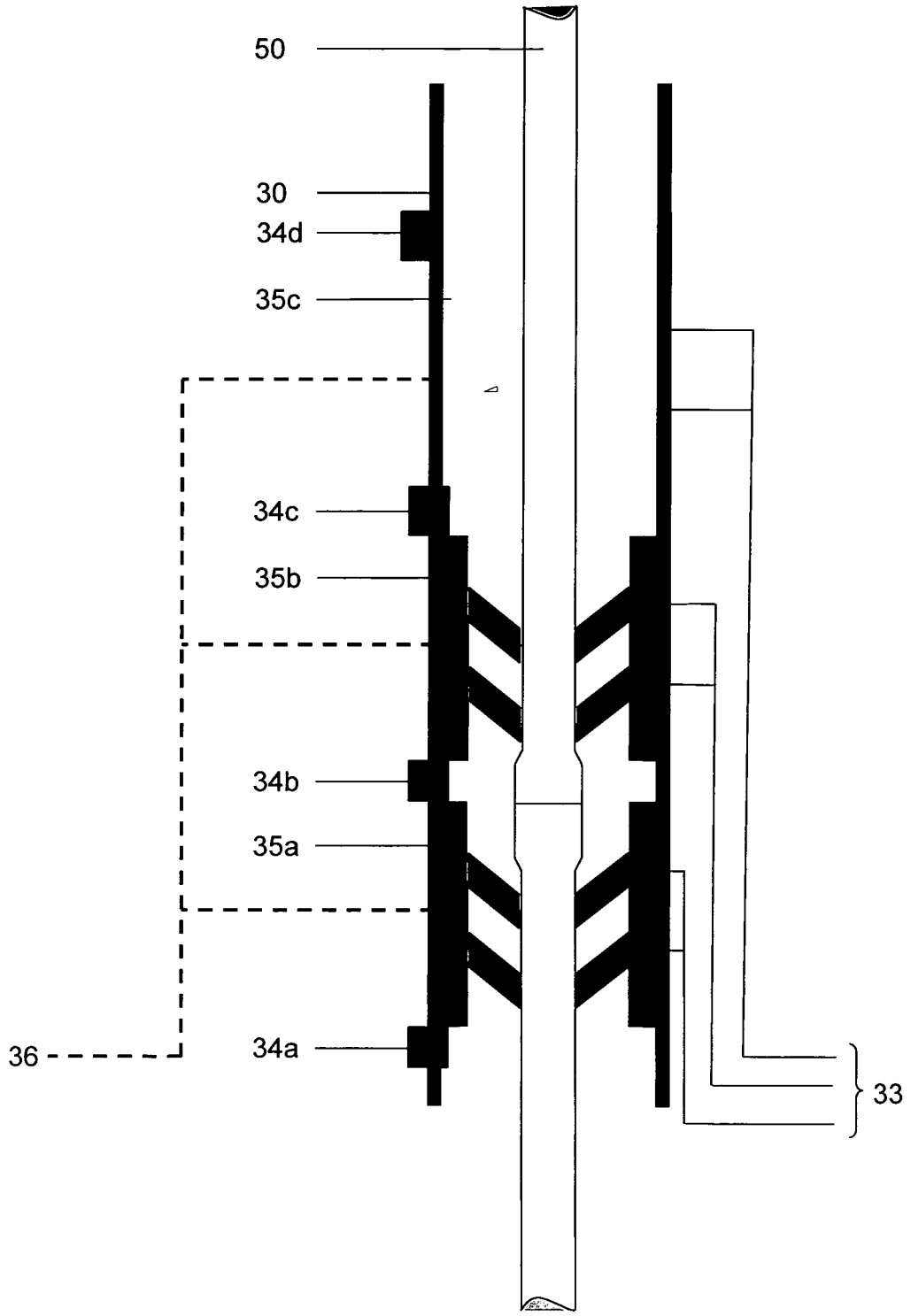

FIG. 7 shows the spare seal 35*b* installed in the receiver part 30 and locked with the help of the locking device 34*c*. The seals 35*a* and 35*b* are thereafter tested and verified with the help of pressure testing and other suitable methods, injection of friction-reducing, sealing and pressure supporting medium can now take place via dedicated injection lines 33. After the necessary tests and verifications have been carried out, the sealing is ready for use and the drilling operation can continue with or without pressure in the riser during the sealing. The possibility to be able to avoid having to break off the drilling operation because of a fault in a seal is unique to the present sealing arrangement and reduces technical, personnel and economic risks for such operations.

Figure 8:
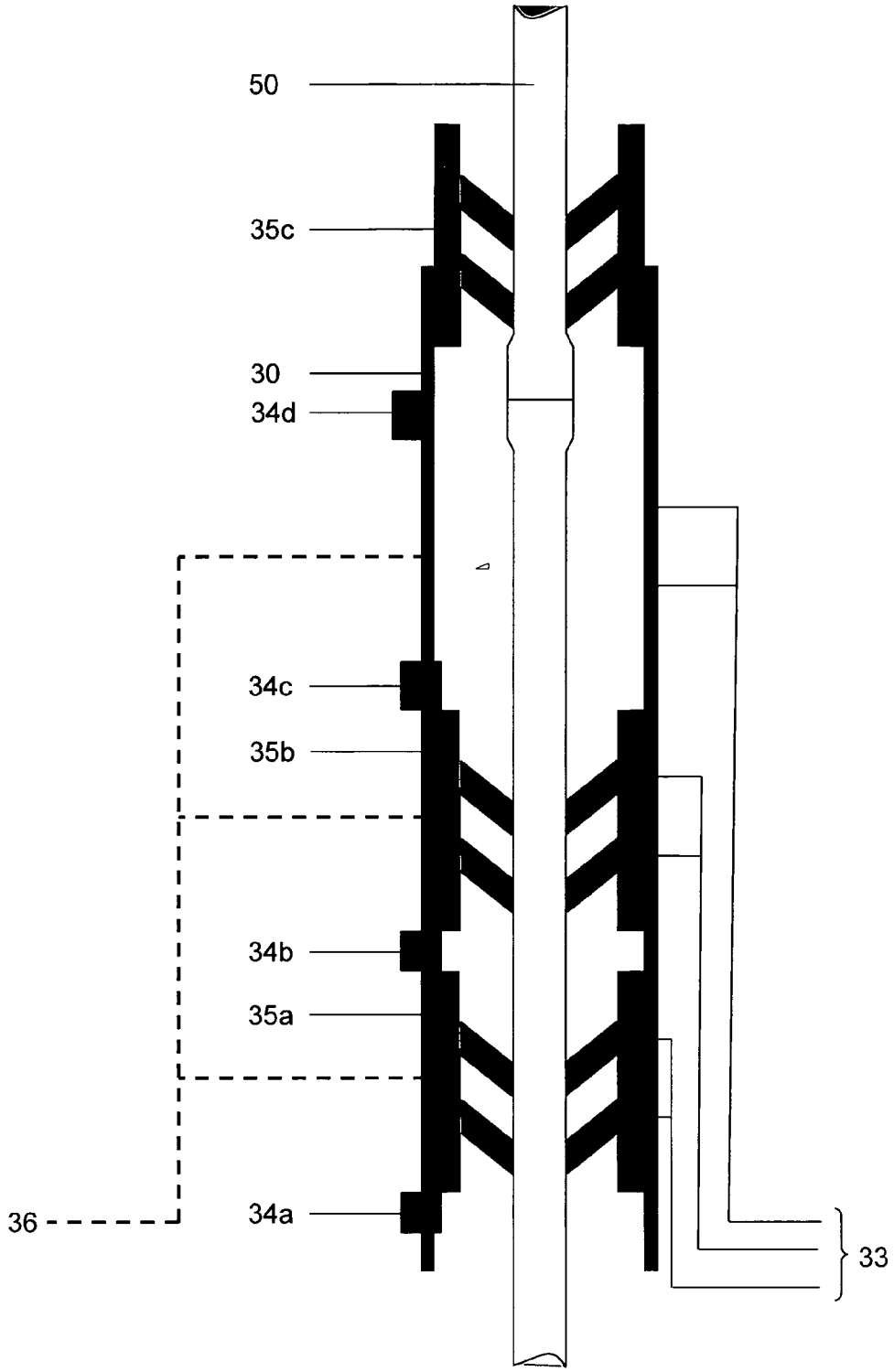

FIG. 8 shows the same principle as FIG. 6, running a new spare seal 35*c*. The individual seal is, as mentioned above, of a defined duration with regard to wear and tear. When this limit is approaching, or one has other indications of wear and tear or a weakening of the already mounted seals, one can choose to install a new spare seal 35*c* so that the drilling operation can continue, or to be certain of safe operations. The spare seal 35*c* is driven down into the receiver part 30, suspended on the drill stem 50. The seal will then come as an additional sealing with respect to the seals 35*a* and 35*b* which are already in place.

Figure 9:
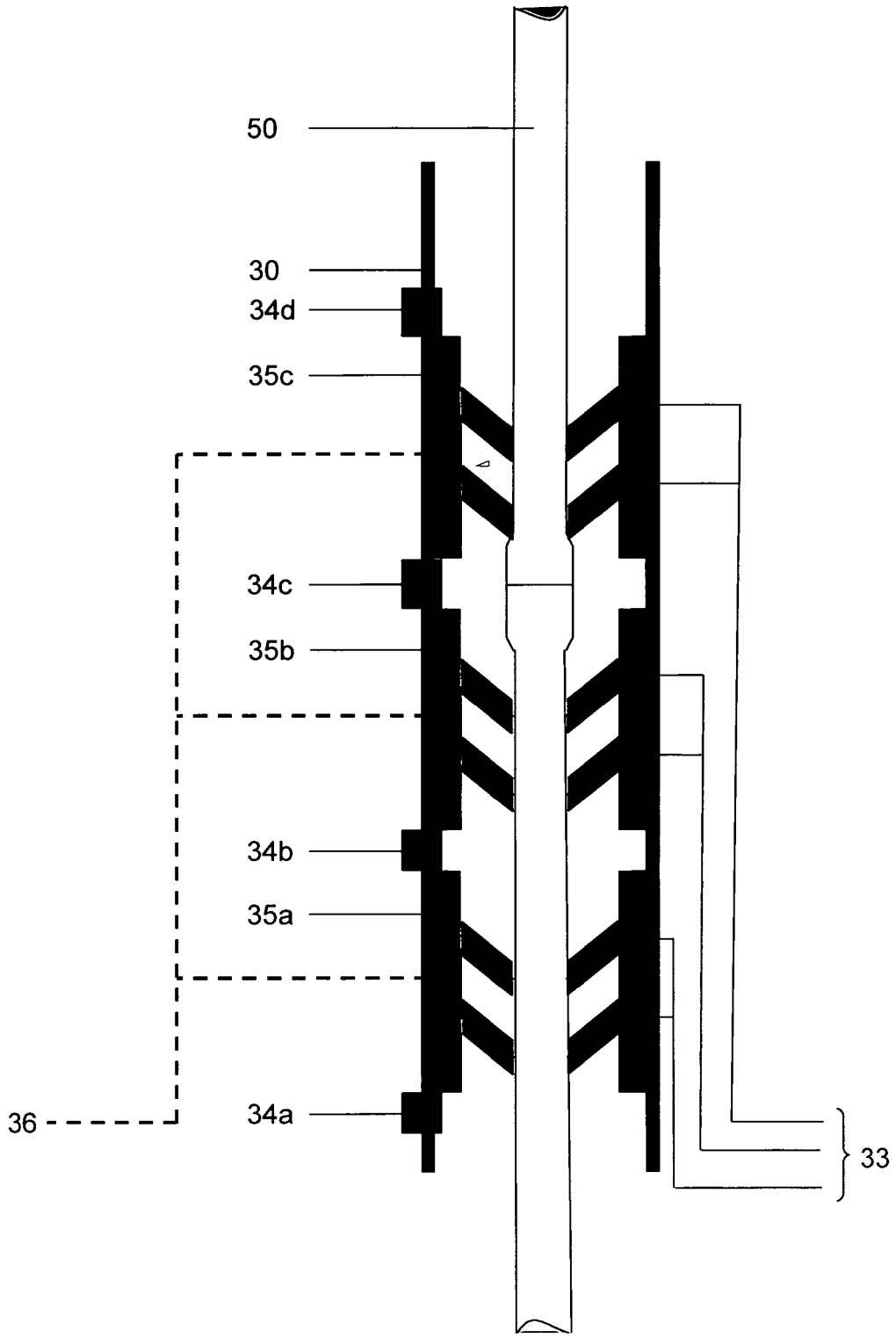

FIG. 9 shows the spare seal 35*c* installed in the receiver part 30 and locked with the help of the locking device 34*d*. The seals 35*a*, 35*b* (what will be left of the sealing function) and 35*c* are thereafter tested and verified with the help of pressure testing and appropriate methods. Injection of a friction reducing, sealing and pressure supporting medium can now take place via dedicated injection lines 33. After the necessary tests and verifications have been carried out the sealing is ready for use and the drilling operation can continue with or without pressure in the riser during the sealing. The sealing arrangement in itself does not put any limitations on how many seals which can be driven in one after the other, but this is, of course, predetermined by the definition of application, design parameters and what is practical for the configuration.

Figure 10:
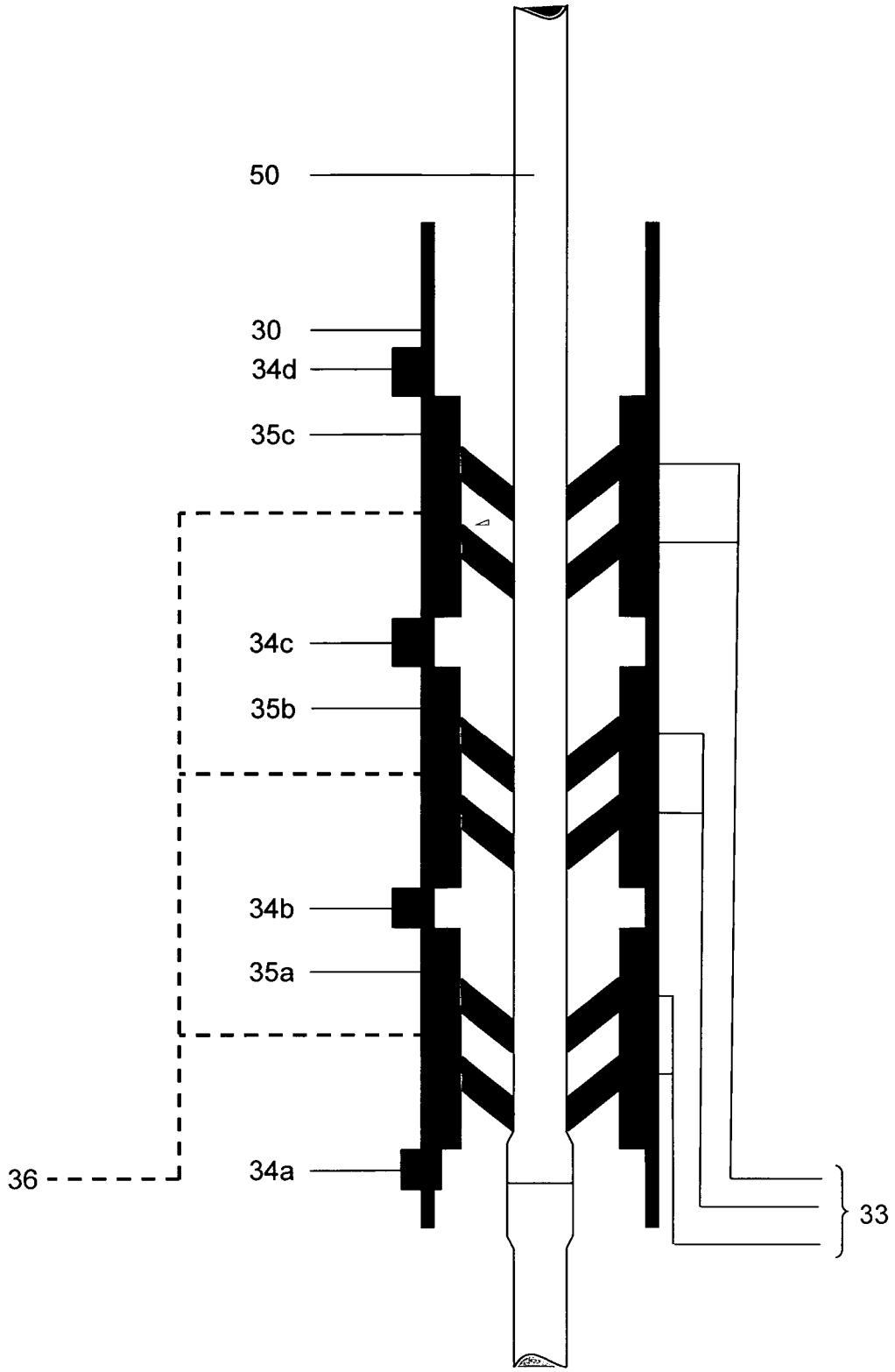

FIG. 10 shows a first step when the operation is at a stage where one shall bring the seals 35*a*, 35*b* and 35*c* out from the receiver part 30 and up onto the drill deck. The locking devices 34*b*, 34*c* and 34*d* release the respective seals. Thereafter, the drill stem 50 can be pulled upwards.

FIG. 11 shows that all the seals 35*a*, 35*b* and 35*c* are pulled out of the receiver part 30 with the help of the coupling on the drill stem 50. Alternatively, a pulling tool can be mounted around the drill stem 50, be driven down through the seals 35*a*, 35*b* and 35*c* to be pulled up again with the help of the drill stem 50, at the same time as the seals 35*a*, 35*b* and 35*c* are pulled out.

The invention claimed is:

1. Method for dynamic sealing around a drill stem and an upper part of a riser in water-carrying, drilling fluid-carrying or hydrocarbon-carrying wells, having a sealing arrangement for a dynamic sealing comprising at least one dynamic seal placed to envelop the drill stem in the riser for closing a drilling fluid return side between the drill stem and the upper part of the riser, with an internal pressure support being provided in the sealing arrangement the method comprising assembling a receiver unit in the riser in which the receiver unit in connection with a floating rig or drilling ship, is arranged below a compensating unit of the riser;

running the drill stem into the riser with a suspended sealing unit;

entering and securely locking the sealing unit to the receiver unit which is mounted as a part of the connection to the well;

running subsequent seals suspended on the drill stem without removal of the first installed seal, and securely locking said seals with the help of respective locking devices at mutually spaced apart locations longitudinally in the receiver unit;

testing and verifying each seal with pressure testing; and injecting pressure medium through dedicated lines in the receiver unit to provide pressure support for the seals.

2. Method according to claim 1, wherein the pressure medium is a lubricant/liquid injected at pressure into the sealing unit through dedicated lines to provide pressure support for the seals so that they withstand pressure, and thus prevent well medium from flowing out into the surroundings.

3. Method according to claim 1, further comprising injecting lubricant/liquid with high viscosity into each seal to lower the friction between the sets of seals and drill stem, and also to cool the friction surfaces.

4. Method according to of the claim 1, wherein placing of the sealing arrangement below the compensating unit of the riser, in connection with a floating rig or drilling ship, makes movement compensation possible between riser and the surface vessel.

5. Method according to claim 1, wherein the drilling fluid is led out through a return line below the sealing arrangement and up to associated systems for further processing, and that control of the sealing arrangement is carried out via a control line and an associated surface system.

6. Method according to claim 1, wherein to be able to pull out the sealing elements from the receiver unit after final use of the last mounted seal or all the seals, dedicated locking devices are opened, for thereafter to pull out the seals by pulling the drill stem out of the well.

* * * * *